US009265297B2

(12) United States Patent
Warmouth et al.

(10) Patent No.: US 9,265,297 B2
(45) Date of Patent: Feb. 23, 2016

(54) FACE GUARD RETAINING DEVICE

(71) Applicant: KRANOS IP CORPORATION, Litchfield, IL (US)

(72) Inventors: Cortney Warmouth, Edwardsville, IL (US); Louis Anthony Vanhoutin, Luka, IL (US); Vincent R. Long, St. Peters, MO (US); Jeff Musec, Edwardsville, IL (US)

(73) Assignee: KRANOS IP CORPORATION, Litchfield, IL (US)

( * ) Notice: Subject to any disclaimer, the term of this patent is extended or adjusted under 35 U.S.C. 154(b) by 0 days.

(21) Appl. No.: 14/337,445

(22) Filed: Jul. 22, 2014

(65) Prior Publication Data

US 2016/0021968 A1 Jan. 28, 2016

(51) Int. Cl.

| | |
|---|---|
| ***A44B 99/00*** | (2010.01) |
| ***A42B 3/32*** | (2006.01) |
| ***A42B 3/20*** | (2006.01) |
| ***A63B 71/10*** | (2006.01) |

(52) U.S. Cl.

CPC . *A42B 3/328* (2013.01); *A42B 3/20* (2013.01); *A44B 99/00* (2013.01); *A63B 71/10* (2013.01); *Y10T 24/44427* (2015.01)

(58) Field of Classification Search

CPC ..... A44B 99/00; Y10T 24/44427; Y10T 24/4453; A42B 3/328; A42B 3/20; A63B 71/10

USPC ..... 24/517, 505, 599.5, 599.9, 601.1, 24/600.8, 645, 498

See application file for complete search history.

(56) References Cited

U.S. PATENT DOCUMENTS

| | | | | | |
|---|---|---|---|---|---|
| 716,472 | A | * | 12/1902 | Pilcher | 24/498 |
| 1,274,006 | A | * | 7/1918 | Clarke et al. | 24/517 |
| 2,456,409 | A | * | 12/1948 | Grewe | 24/517 |
| 3,235,928 | A | * | 2/1966 | Clark | 24/517 |
| 4,701,983 | A | * | 10/1987 | Warmath | 24/511 |
| 5,402,558 | A | * | 4/1995 | Santapa | 24/511 |
| 8,756,771 | B1 | * | 6/2014 | Moreau et al. | 24/517 |

* cited by examiner

*Primary Examiner* — Abigail Morrell
(74) *Attorney, Agent, or Firm* — Notaro, Michalos & Zaccaria P.C.

(57) ABSTRACT

A quick-release retaining device for securing a faceguard to a helmet shell. A selectively engageable latch structure maintains the retaining device in a closed condition. When the retaining device is urged to the open condition, the faceguard may be moved away from a wearer's face. The device is biased in the closed condition by a C-shaped clip, and has a sliding-bar feature for additional securement. The sliding bar is further secured by a locking pin.

17 Claims, 11 Drawing Sheets

FACE GUARD RETAINING DEVICE

FIELD AND BACKGROUND OF THE INVENTION

1. Field of the Invention

The present invention relates generally to the field of protective helmets, and in particular, to a new and useful device for releasable attachment of a faceguard to a helmet shell.

2. Background of the Invention

In many sports, it is desirable for participants to wear a helmet shell to protect against head injury as a result of collisions. This is particularly the case in youth sports. It may also be desirable to protect the face by providing a generally cage-like faceguard across the front of the helmet shell. This provides frontal protection while retaining substantial frontal visibility. Such combinations of helmet shells and faceguards may be used in a number of sports, including football, lacrosse, baseball, fast-pitch softball, hockey, and the like.

In the event of injury, the faceguard may impede the ability of medical personnel to render assistance, as they will be unable to directly access the injured player's face to conduct tests and render treatment with the helmet shell and faceguard in place. The presence of a faceguard may also make it difficult to administer emergency aid such as, for example, mouth-to-mouth resuscitation. While access to the player's face may be achieved by removing the entire helmet shell with the faceguard attached, such removal may be undesirable in the event of a suspected brain or spinal injury. When such injuries are suspected, the general recommendation is to minimize head and neck movement. To avoid moving the player's head under such conditions, it may be necessary to remove the faceguard from the helmet shell prior to administering treatment. However, such removal tends to be relatively time-consuming and, in an emergency situation, complex. Thus, there is a need for a faceguard attachment system which permits rapid displacement of the faceguard without requiring removal of the entire helmet shell.

U.S. publication no. 2012/0011686 by Duong attempts to address these issues by teaching clips for securing a face mask to an article of head gear, and for releasing the face mask without the need for any special tools or equipment. The reference teaches that the clip may comprise a base and a retaining member that is pivotably coupled to the base. When the retaining member is engaged with the base, structure on the base prevents the retaining member from pivoting open, thus securing the face mask within the clip. To disengage the retaining member and release the face mask from the clip, a user may squeeze or flex a portion of the base, which causes the retaining member to disengage and pivot open.

Among other things, the reference fails to teach a shock stabilizer, or any other piece made of a material softer than the base or retaining member. Thus, upon impact there is no "give" in the device and such is important for allowing for effective absorption of impact.

U.S. publication no. 2010/0251464 by Parisi also attempts to address the problem. The reference teaches an attachment system for operative connection of a faceguard to a helmet shell with the faceguard being held within a selectively releasable clamp operatively secured to the helmet shell. The attachment system includes a compressible spring clip held in overlying relation to the helmet shell. The spring clip is adapted to selectively clamp a bridge member of the faceguard. A selectively engageable latch structure holds the spring clip in the closed condition. Upon release of the latch structure, the spring clip is urged to the open condition, such that the faceguard may be rotated away from a user's face.

This device relies on a locking-arm-and-latch structure. The locking arm includes an angled head having a half arrowhead profile adapted for receipt through an acceptance slot (see FIG. 5). Impact of sufficient force can cause the locking arm to break and/or fail. The reliance on this structure, thus, presents a significant safety issue, as the faceguard may then fall off during play.

Thus, a need remains for further advancements in the field of helmet design, in particular for a face guard securing device which provides optimal securement of the face guard to the helmet, but which can be quickly and easily released.

SUMMARY OF THE INVENTION

Accordingly, one of the various objects of the invention is to provide a device for effectively securing a faceguard to a helmet.

It is also an object of the present invention to provide a device which allows for quick removal of the faceguard from the helmet.

The present invention is a quick-release face guard retaining device having a cooperating base and a latch.

The base has an overlying portion and an underlying portion. It has an opening in the underlying portion for connecting the device to a helmet by, for example, a screw and T-nut.

There is a grommet located in the opening of the base, the grommet defining a grommet opening. There is, in typical embodiments, a spacer located in the grommet opening. The grommet is typically a shock-absorbing disc. The shock-absorbing disc has a platform base and a raised surface. The raised surface is typically composed of two opposed crescents arranged to accommodate a curvature of the spacer. The grommet is, in certain embodiments, made of SURLYN.

The device also has a shock stabilizer located in a shock stabilizer-receiving groove of the base. The shock stabilizer is of a softer material than the base. For example, the shock stabilizer maybe made of rubber, and the base made from a thermoplastic polymer, such as a hard polycarbonate.

The latch is connected to the base in a hinged manner, and has a hooked part at one end.

The base, shock stabilizer and latch together define a receiving aperture in a closed condition for securing a faceguard wire in the device.

The device also has a clip disposed in between the base and the latch. The clip has curved parts at a first end and at a second end. The clip is secured within a clip-receiving part of the base at the first end and within a clip-receiving part of the latch at the second end. The clip exerts closing forces on the latch and the base, so that, overall, the retaining device is biased to a closed condition.

For added security, the present quick release retaining device may be locked. There is a sliding bar located in a bar-receiving groove of the base. The latch also has a sliding bar receiving groove. The groove of the latch is located such that, when the device is in the closed position, the grooves of the base and the latch are aligned.

The device is in the locked condition when the sliding bar-receiving grooves of the latch and base are aligned, and the sliding bar is located within a common groove formed by the aligned bar-receiving grooves of the latch and the base.

The sliding bar has an opening provided with a pin for enhanced locking. The sliding bar receiving groove of the base is provided with a pin-receiving cavity. The pin and the pin receiving cavity are oriented such that, when the sliding bar is pushed over the latch, the pin slides into the pin-receiving cavity. The pin and the pin-receiving cavity cooperate to provide a resistance to movement of the sliding bar away from the latch. The pin is forced from the pin-receiving cavity upon application of force against the sliding bar greater than the resistance provided by the cooperation of the pin and the pin-receiving cavity The sliding bar may also be used to set the device in an open condition. The device is set in the open condition by pulling the sliding bar from of the aligned bar-receiving grooves, pulling the latch away from the base, pushing the sliding bar back through the a bar-receiving groove of the base so that it extends underneath the latch, and releasing the latch to rest on the sliding bar.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
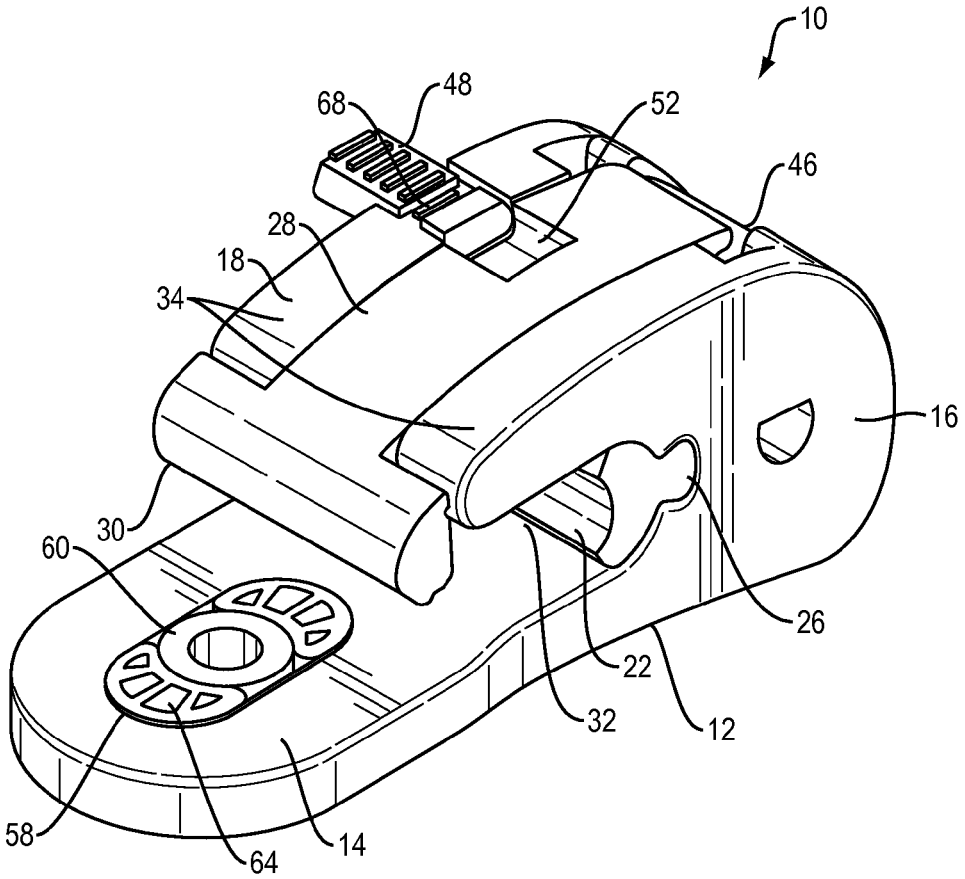
FIG. 1 is a perspective view of the quick-release retaining device in a closed, unlocked condition.
Figure 2:
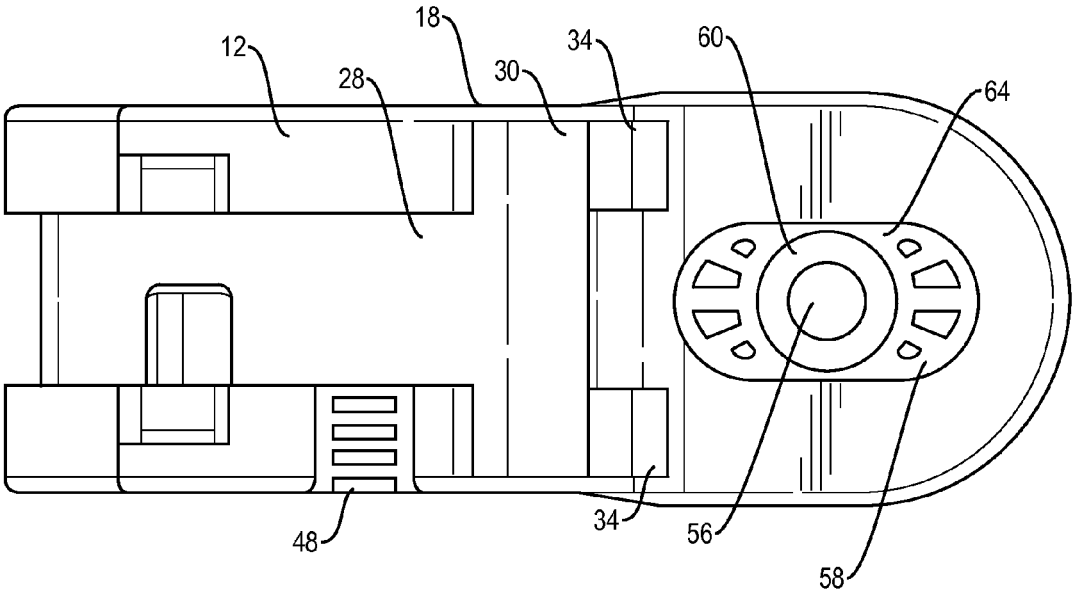
FIG. 2 is a top plan view of the device in the open condition.

Referring now to the drawings, FIG. 1 shows a quick-release face guard retaining device 10 adapted to hold a face guard wire (not shown) to the shell of a helmet (not shown).

Figure 3:
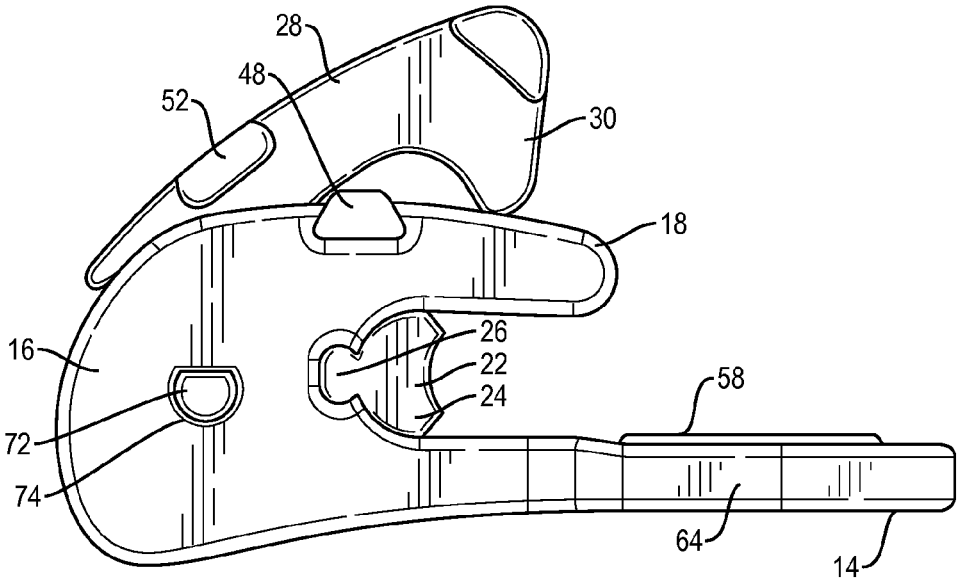
FIG. 3 is a left side elevational view of the device in the open condition.
Figure 4:
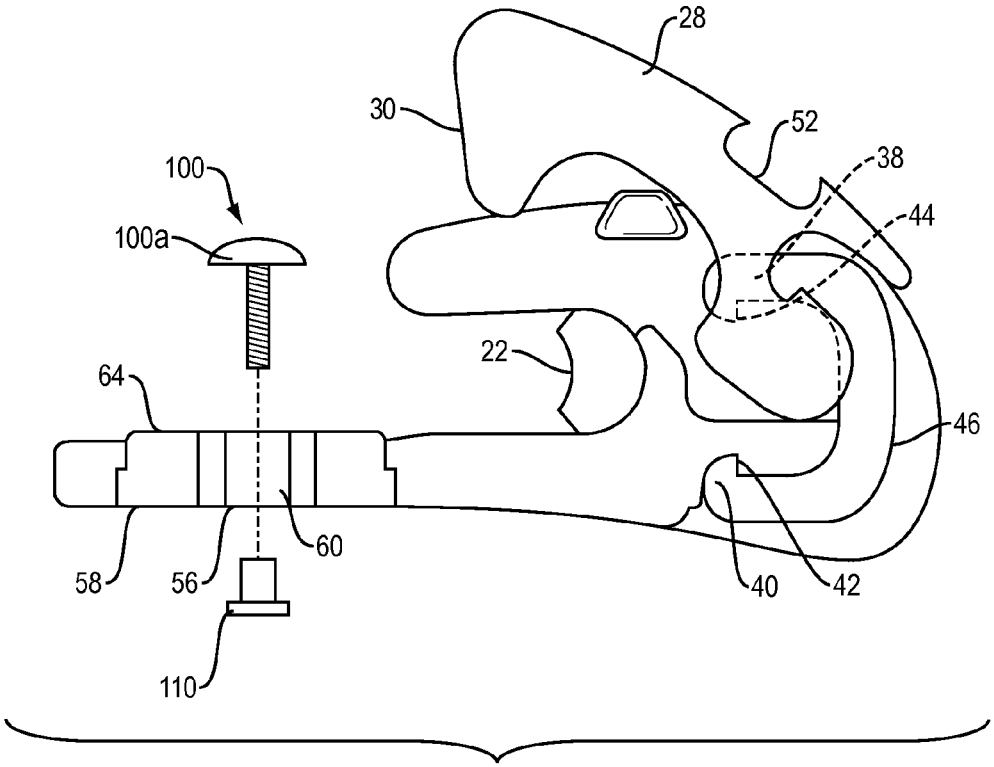
FIG. 4 is a cross-sectional view of the device, taken along line 5-5 of FIG. 4.

As best seen by reference to FIGS. 1, 3 and 4, the retaining device 10 includes a base 12 having a generally hairpin construction. The base has an underlying portion 14 continuous with a curved portion 16 and an overlying portion 18. The overlying portion 18 consists of two parallel arms 34 which partially extend over the length of the underlying portion 14. The underside of the base 12 has a concave curvature to accommodate the curvature of a typical sports helmet.

Figure 7:
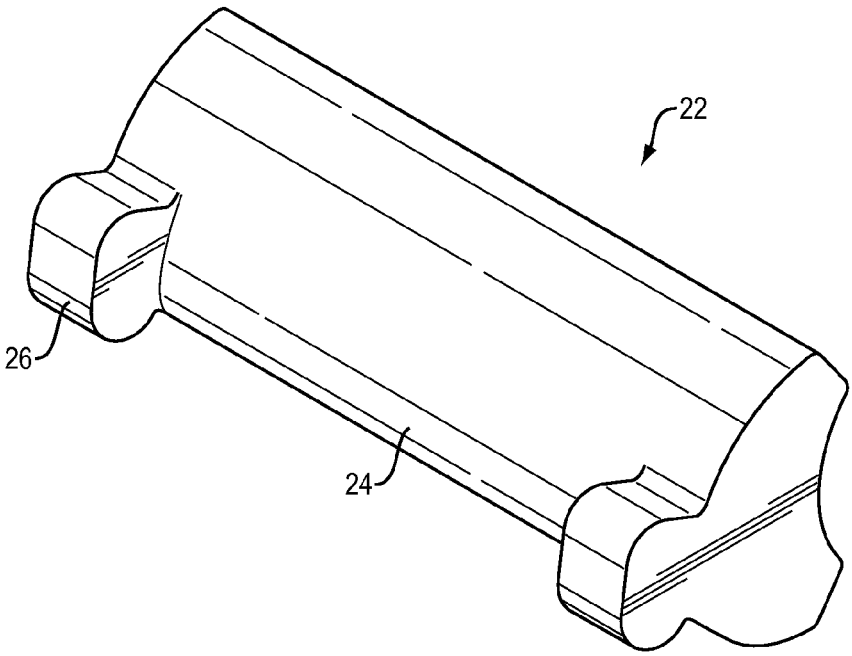
FIG. 7 is a perspective view of the shock stabilizer.

The curved portion 16 has a receiving groove Jul. 16, 2014 defined therein which receives a shock stabilizer 22. As seen in FIG. 7, the shock stabilizer 22 has a main portion 24 and a pair of backward-projecting legs 26. The shock stabilizer 22 is secured to the base 12 by sliding the backward-projecting legs 26 into the receiving groove 20 of the base 12. The main portion 24 of the shock stabilizer 22 is concave so as to receive and secure a face guard wire.

In a typical embodiment, the shock stabilizer 22 is made of a softer material than the material from which the base 12 is made. The relative softness of the shock stabilizer 22 allows for some give, in the event of impact against the faceguard from an axially-opposed force, such as from another helmet or the ground. Preferably, the shock stabilizer 22 is made of rubber and the base 12 is made of a hard polycarbonate. These are non-limiting examples, as the base 12 and shock stabilizer 22 may each be made of any convenient material such that there is a differential in hardness between them.

As seen in FIGS. 1-4 and 6, the retaining device 10 also has a T-shaped top latch 28 secured in a hinged manner to the base 12. Specifically, lateral projections 72 on the latch 28 sit inside lateral openings 74 in the base 12.

The latch 28 has a hooked part 30. In the locked position, the hooked part 30 presses the faceguard wire against the underlying portion 14 of the base 12 and against the shock stabilizer 22.

Thus, when the hooked part 30 is in contact with the base 12, the latch 28, the base 12, and the shock stabilizer 22 define a receiving aperture 32 for enclosing the wire of a faceguard. In a preferred embodiment, the receiving aperture 32 has an arcuate cross-section. However, it is within the scope of the invention for the receiving aperture 32 to have a cross section of any convenient shape, in accordance with the profile of the particular faceguard wire to be accommodated.

Figure 8:
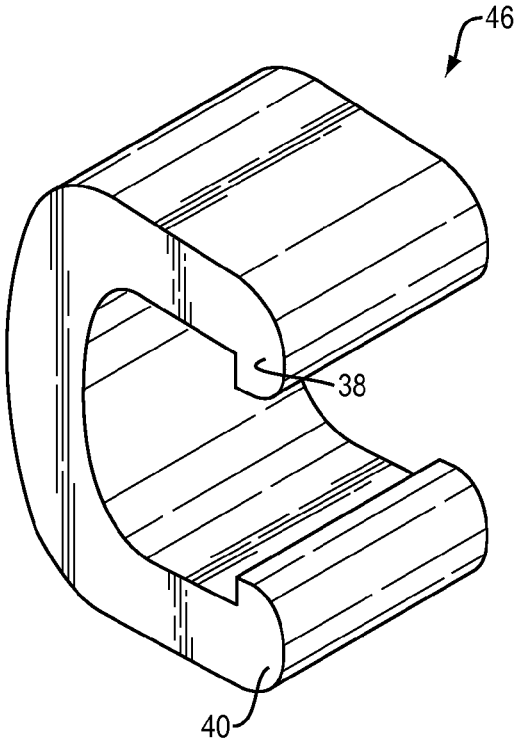
FIG. 8 is a perspective view of the C-shaped clip.

The base 12 and the latch 28 are further secured by a substantiality C-shaped clip 46. As shown in FIGS. 4 and 8, the clip 46 has curved parts 38, 40 at either end, so that it may be secured within a clip-receiving groove 42 of the base 12 at one end and within a clip-receiving groove 44 of the latch 28 at the other end. The clip 46 exerts constant closing forces on the latch 28 and the base 12, so that the retaining device 10 is biased to the closed condition.

Figure 5:
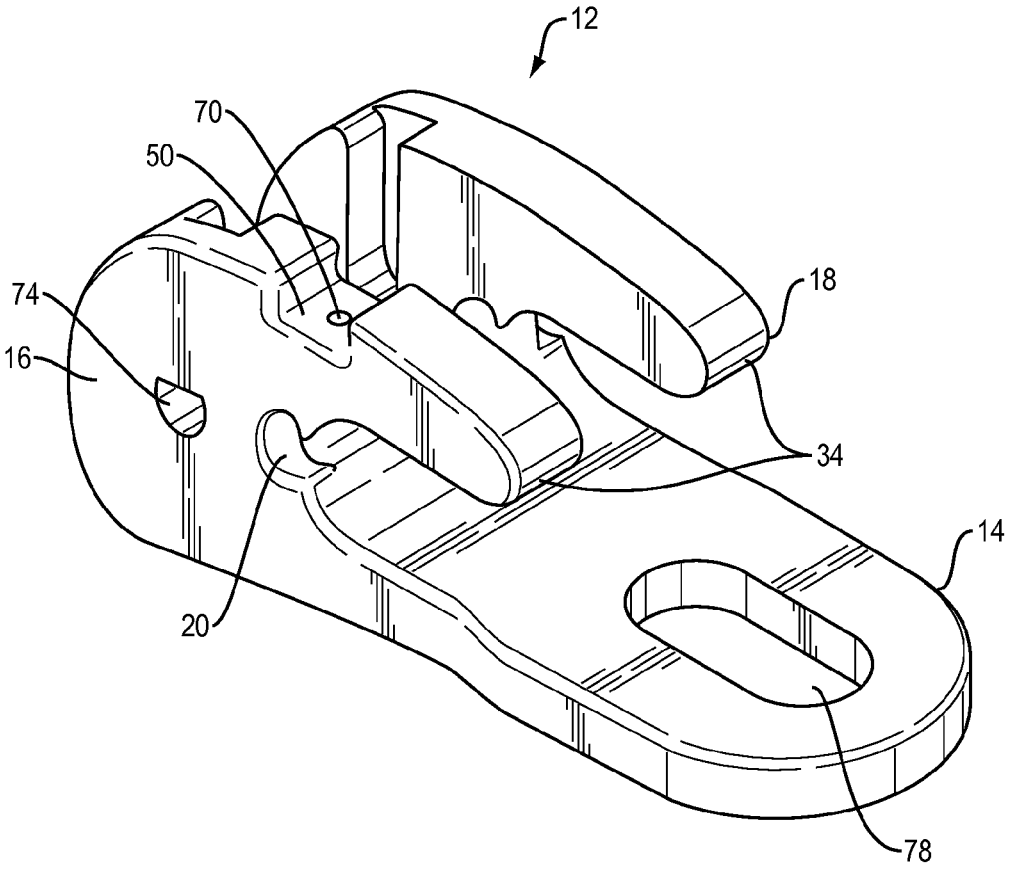
FIG. 5 is a perspective view of the base.
Figure 6:
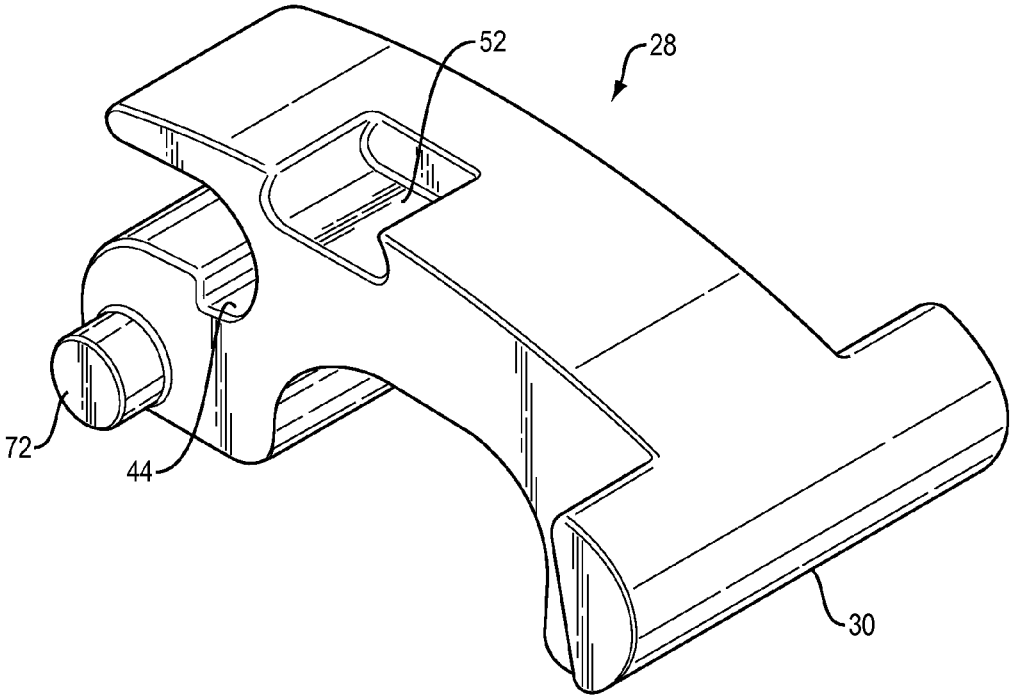
FIG. 6 is a perspective view of the latch.

The retaining device 10 is also provided with a sliding bar 48 located in a bar-receiving groove 50. As best seen in FIG. 5, the bar-receiving groove 50 is formed in the overlying portion 18 of the base 12. There is also a bar-receiving groove 52 in the upper side of the latch 28. When the retaining device 10 is in the locked condition, bar-receiving grooves 50, 52 are aligned, and the sliding bar 48 is located within a common groove formed by the bar-receiving grooves 50, 52. The sliding bar is optionally provided with multiple ridges 76 for ease of sliding.

As noted, the clip 46 exerts constant closing forces on the latch 28 and the base 12, which biases the retaining device 10 in the closed condition. In order to set and maintain the retaining device in an open condition, a user moves the sliding bar 48 out of the aligned bar-receiving grooves 50, 52. The user then pulls the hooked part 30 of the latch 28 away from the underlying portion 14 of the base 12. With the latch 28 in a raised position, the user pushes the sliding bar 48 back through the bar-receiving groove 50 in the overlying portion 18 of the base 12, so that it extends underneath the latch 28. When the latch 28 is released, it rests on the sliding bar 48, leaving the retaining device 10 in the open condition.

As an added feature for securing the sliding bar 48 over the latch 28, the sliding bar 48 has a hole 66 which is provided with a locking pin 68. In operation, when the sliding bar 48 is pushed over the latch, the pin 68 slides into a receiving cavity 70 in the overlying portion 18 of the base 12, and locks into place. This feature provides an additional measure for keeping the latch 28 down, in event of impact against the faceguard. When the sliding bar 48 is deliberately pushed away from the latch 28 with sufficient force, the pin 68 is forced out of the receiving cavity.

Typical embodiments include a grommet 58 located in an opening 78 in the base. The retaining device 10 may be secured to a sports helmet by a screw 100 passed through an opening 56 in the grommet 58. The screw 100 is passed further into a T-nut 110 inside the sports helmet (not shown). The screw 100 and T-nut 110 fix the base 12 to the helmet shell. In certain of these embodiments, there is a spacer 60 located in the opening 56 of the grommet 58.

Figure 9:
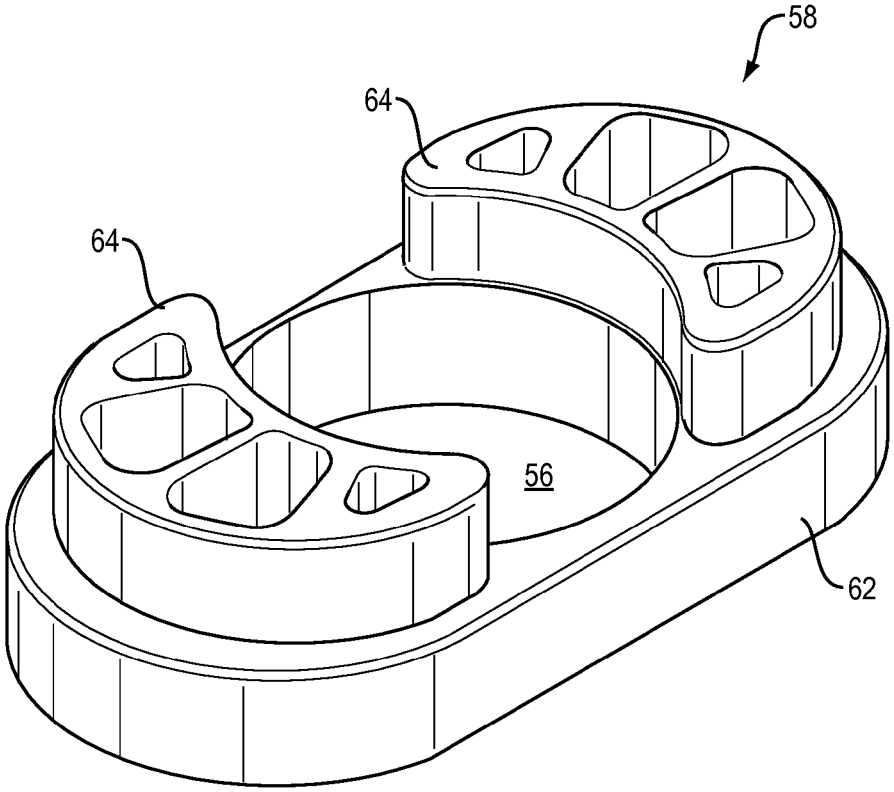
FIG. 9 is a perspective view of the grommet.
Figure 10:
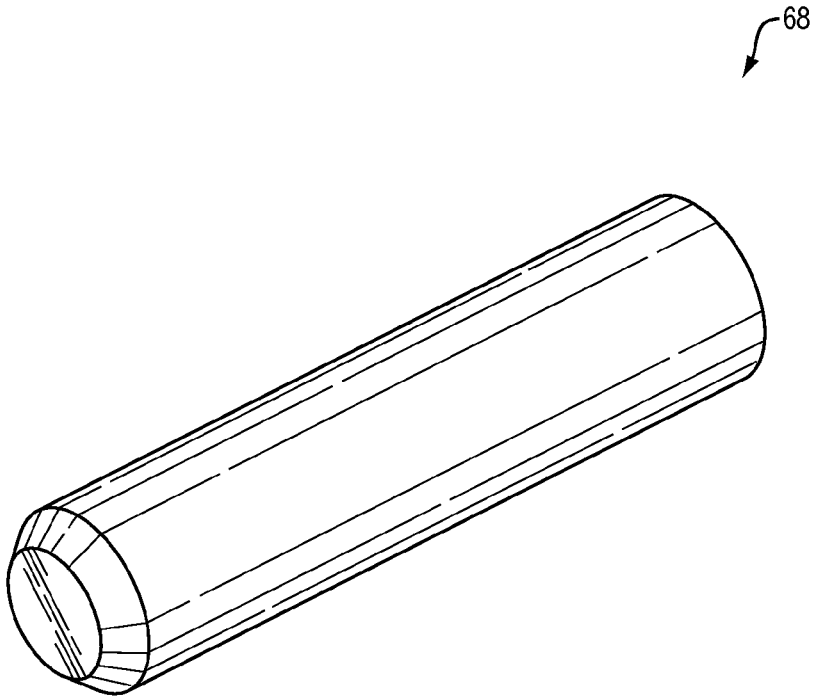
FIG. 10 is a perspective view of the locking pin.
Figure 11:
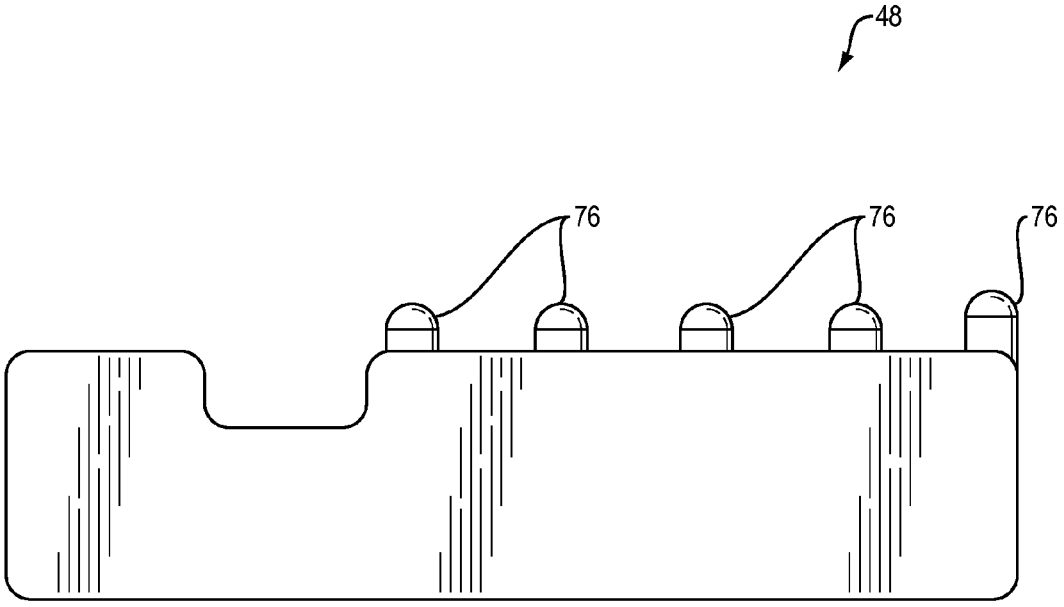
FIG. 11 is a right side elevational view of the sliding bar.

In typical embodiments, the grommet 58 is shock-absorbing disc having a two-tiered structure, including a platform base 62 and a raised surface 64, as best understood with reference to FIG. 9. The raised surface 64 is composed of two opposed crescents arranged to accommodate curvature of the spacer 60. The raised surface 64 is disposed in surrounding relation to the opening 56.

As best observed in FIGS. 3 and 4, the raised surface 64 protrudes slightly above the surface of the base. Thus, when the screw 100 is moved into the opening 56, the raised surface 64 may apply an upward biasing force against the underside of the screw head 100*a* to aid in forming a locked relation between the retaining device 10 and the underlying helmet shell. That is, the raised surface 64 acts as a wedge which is held in compression between the helmet shell and a downwardly facing surface of the screw head 100*a*. With the raised surface 64 held in compression between the helmet shell and a downwardly facing surface of the screw head 100*a*, slippage is minimized between the retaining device 10 and the underlying helmet shell.

In preferred embodiments, the grommet 58 is composed of SURLYN, but other materials maybe used such as any synthetic or natural material that may be shaped when soft and then hardened, including many types of resins, resinoids, and polymers (Nylon, Polyester, Acetal, Polypropylene). These may be used, alone or in combination.

In preferred embodiments, the base 12 has a width of about 0.800 inches to 1.000 inches, and most preferably has a width of about 0.890 inches in the region which houses the grommet 58 and about 0.830 inches in the region where the hinged connection is formed with the latch 28. The base 12 has a preferred height in the range of about 0.850 inches to about 1.050 inches, and most preferably has a height of about 0.934 inches. The base 12 has a preferred length of about 1.300 inches to 3.300 inches, and most preferably a length of about 2.270 inches. The distance from the edge of the overlying portion 18 of the base 12 downward to the underlying portion 14 is preferably in the range of about 0.200 inches to about 0.400 inches, and most preferably about 0.320 inches. The distance between the parallel arms 34 of the overlying portion 18 is preferably in the range of about 0.300 inches to about 0.500 inches, and most preferably about 0.390 inches.

The latch 28 has a preferred height in the range of about 0.450 inches to 0.650 inches, and most preferably 0.560 inches. The latch 28 has a preferred length in the range of about 1.250 inches to about 1.450 inches and most preferably a length of about 1.360 inches. The width of the latch 28 from one end of the hooked part 30 to the other is preferably in the range of about 0.700 inches to 0.900 inches and most preferably about 0.790 inches. The width of the latch 28 from the ends of lateral projections 72 is preferably about 0.500 inches to 0.700 inches, and most preferably 0.580 inches. The width of the latch in the area between the hooked part 30 and the lateral projections 72 is preferably about 0.300 inches to 0.500 inches and most preferably about 0.380 inches.

The C-shaped clip 46 has a thickness preferably in the range of about 0.050 inches to 0.250 inches and most preferably about 0.140 inches. The C-shaped clip 46 has a width preferably of about 0.275 inches to 0.475 inches and most preferably about 0.375 inches. The C-shaped clip 46 preferably has a height of about 0.550 inches to about 0.750 inches and most preferably about 0.670 inches.

The shock stabilizer 22 preferably has a length, measured from the edge of the backward-projecting legs 26 to the edge of the main portion 24 of about 0.200 inches to about 0.400 inches and most preferably about 0.310 inches.

The grommet 58 has a diameter of about 0.300 inches to about 0.500 inches, and preferably about 0.380 inches. The grommet opening 56 preferably has a diameter in the range of about 0.200 inches to 0.400 inches, and most preferably about 0.316 inches. The height of the platform base 62 is preferably about 0.050 inches to about 0.150 inches, and most preferably about 0.100 inches. The length of the platform base 62 is preferably about 0.600 inches to 0.800 inches and most preferably 0.710 inches The height from the top of the raised surface to the bottom of the platform base 62 is preferably about 0.100 inches to 0.300 inches, and most preferably about 0.188 inches.

The spacer 60 preferably has a diameter of about 0.330 inches to about 0.300 inches and most preferably about 0.313 inches. The diameter of the opening of the spacer is preferably about 0.170 inches to 0.160 inches and most preferably 0.166 inches.

The height of the sliding bar 48 is preferably about 0.075 inches to 0.150 inches and most preferably about 0.125 inches. The width of the sliding bar 48 is preferably about 0.200 inches to 0.3000 inches and most preferably about 0.246 inches. The length of the sliding bar 48 is preferably about 0.300 inches to about 0.500 inches and most preferably about 0.410 inches.

The pin 68 preferably has a height of about 0.7500 millimeters to 0.250 millimeters, and most preferably about 0.500 millimeters.

While a specific embodiment of the invention has been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention. Thus, all the features of all the embodiments disclosed herein are interchangeable so that any element of any embodiment may be applied to any of the embodiments taught herein.

What is claimed is:

1. A quick-release face guard retaining device, comprising:

a base, the base defining a shock stabilizer-receiving groove, a grommet-receiving opening, and a sliding bar-receiving groove;

a latch, the latch hingedly-connected to the base, the latch further comprising a hooked part at a distal end thereof and defining a sliding bar-receiving groove;

clip having a first end and a second end, the clip being secured within a clip-receiving part of the base at the first end and within a clip-receiving part of the latch at the second end;

a sliding bar located in the sliding bar-receiving groove of the base;

a shock stabilizer located in shock stabilizer-receiving groove of the base;

a grommet located in the opening of the base, the grommet defining a grommet opening, wherein the base, the shock stabilizer and the latch are adapted to cooperatively define a receiving aperture in a closed condition for securing a faceguard wire in the device, and wherein the clip is adapted to exert closing forces on the latch and the base, so that the retaining device is biased to the closed condition.

2. The quick-release face guard retaining device of claim 1, wherein the shock stabilizer is of a softer material than the base.

3. The quick-release face guard retaining device of claim 2, wherein the shock stabilizer comprises rubber.

4. The quick-release face guard retaining device of claim 1, wherein the grommet comprises SURLYN.

5. The quick-release face guard retaining device of claim 1, wherein the base comprises a thermoplastic polymer.

6. The quick-release face guard retaining device of claim 5, wherein the base is made of a hard polycarbonate.

7. The quick-release face guard retaining device of claim 1, wherein the grommet is a shock-absorbing disc.

8. The quick-release face guard retaining device of claim 7, wherein the shock-absorbing disc comprises a platform base and a raised surface.

9. The quick-release face guard retaining device of claim 8, wherein the raised surface comprises two opposed crescents arranged to accommodate a curvature of the grommet opening.

10. The quick-release face guard retaining device of claim 1, wherein the base is adapted to be fixed to a helmet shell, and wherein the grommet opening is adapted to receive a screw.

11. The quick-release face guard retaining device of claim 10, wherein the base has a concave curvature along an underside thereof.

12. The quick-release face guard retaining device of claim 1, further comprising a spacer located in the grommet opening.

13. The quick-release face guard retaining device of claim 1, wherein the retaining device is in a locked condition when the sliding bar-receiving grooves of the latch and the base are aligned, and the sliding bar is located within a common groove formed by the bar-receiving grooves of the latch and the base.

14. The quick-release face guard retaining device of claim 13, wherein the device is adapted to be set in an open condition by pulling the sliding bar from the aligned bar-receiving grooves, pulling the latch away from the base, pushing the sliding bar back through the bar-receiving groove of the base so that it extends underneath the latch, and releasing the latch to rest on the sliding bar.

15. The quick-release face guard retaining device of claim 1, wherein the sliding bar defines an opening, the opening of the sliding bar being provided with a pin, and the base being provided with a pin-receiving cavity in the bar-receiving groove.

16. The quick-release face guard retaining device of claim 15, wherein the pin and the pin receiving cavity are oriented such that, when the sliding bar is pushed over the latch, the pin slides into the pin-receiving cavity, and the pin and the pin-receiving cavity cooperate in providing a resistance to movement of the sliding bar away from the latch.

17. The quick-release face guard retaining device of claim 16, wherein the pin is adapted to be forced from the pin-receiving cavity upon application of force against the sliding bar greater than the resistance provided by the cooperation of the pin and the pin-receiving cavity.

* * * * *